US005361112A

United States Patent [19]

Pummell et al.

[11] Patent Number: 5,361,112

[45] Date of Patent: Nov. 1, 1994

[54] FILM LENGTH CHECKING APPARATUS

[75] Inventors: Leslie J. H. Pummell, Rickmansworth; Paul C. Ward, Oxhey; Stephen J. Kingdon, St. Albans; James A. Oldfield, Great Missenden, all of United Kingdom

[73] Assignee: Eastman Kodak Company, Rochester, N.Y.

[21] Appl. No.: 36,313

[22] Filed: Mar. 24, 1993

[30] Foreign Application Priority Data

Mar. 24, 1992 [GB] United Kingdom ..... 9206392.6

[51] Int. Cl.[5] ..... G03D 13/00

[52] U.S. Cl. ..... 354/298; 354/319

[58] Field of Search ..... 354/317–323, 354/334, 298, 313, 314; 355/27, 28; 226/27, 90

[56] References Cited

U.S. PATENT DOCUMENTS

| | | | |
|---|---|---|---|
| 2,251,306 | 8/1941 | Thompson et al. | 250/41.5 |
| 2,341,011 | 2/1944 | Bascom et al. | 164/68 |
| 2,880,325 | 3/1959 | Tuttle et al. | 250/66 |
| 3,383,996 | 5/1968 | Dokulil et al. | 95/94 |
| 3,577,302 | 5/1971 | Szakacs | 156/504 |
| 3,779,440 | 12/1973 | Casale et al. | 226/74 |
| 4,067,035 | 1/1978 | Plursch et al. | 354/313 |
| 4,331,275 | 5/1982 | Therien et al. | 226/188 |
| 4,366,372 | 12/1982 | Sargent | 235/92 |
| 4,396,277 | 8/1983 | Hunt | 355/29 |
| 4,403,846 | 9/1983 | Osgowitsch et al. | 354/310 |
| 4,411,725 | 10/1983 | Siegel et al. | 156/353 |
| 4,574,692 | 3/1986 | Wahli et al. | 101/2 |
| 4,576,469 | 3/1986 | Shiga et al. | 355/29 |
| 4,724,463 | 2/1988 | Matsumoto | 355/29 |
| 4,862,200 | 8/1989 | Hicks | 354/75 |
| 4,894,675 | 1/1990 | Wurfe et al. | 354/308 |
| 4,906,854 | 3/1990 | Rauh et al. | 250/561 |
| 4,925,119 | 5/1990 | Shimizu et al. | 242/57 |
| 4,947,685 | 8/1990 | Montgomery et al. | 73/159 |
| 4,949,114 | 8/1990 | Combet et al. | 354/313 |

OTHER PUBLICATIONS

Patent Abstracts of Japan, JP-A-57 139 726, (Olympus K.K.) Aug. 28, 1982, vol. 006, No. 241 (P-158) Nov. 30, 1982.

*Primary Examiner*—D. Rutledge
*Attorney, Agent, or Firm*—Frank Pincelli

[57] ABSTRACT

In some types of processing apparatus, there is a minimum length of film strip which can be processed. To overcome this problem, several film strips may be spliced together to provide the desired length and/or a leader attached to the leading edge of the film strip to guide it through the apparatus for processing. Described herein is a loading device (10) for photographic processing apparatus which allows a length of film (102) to be unloaded from its cassette (100) in a film unloading station, its length checked at a film length checking station (18), and passed to a storage station (16) prior to being directed to the processing apparatus. Any length of film not exceeding the minimum length requirement for the processing apparatus can be removed from the storage station thereby avoiding film jams because the film is too short to pass from one transport station to another in the processing apparatus.

10 Claims, 2 Drawing Sheets

FILM LENGTH CHECKING APPARATUS

FIELD OF THE INVENTION

This invention relates to film length checking apparatus and is more particularly concerned with such apparatus for use in loading devices which automatically unload a film from its cassette prior to feeding it into photographic processing apparatus.

BACKGROUND INFORMATION

Most photographic film now used is 35 mm format film. Cameras have been developed to allow film of this format to be easily loaded by placing the film cassette, in which the film is stored, into an opening in the back of the camera and then shutting the back of the camera. As a free end or tongue of the film extends externally to the film cassette, this is used to automatically advance the film in the camera for picture taking. Once all the pictures have been taken, the film is rewound into the film cassette for removal from the camera for processing. In order for this to work, the free end or tongue of the film must extend externally to the cassette so that it can be pulled on to the take-up spool in the camera as the film is first loaded.

Photographic film tends to be processed in a single strip once the film has been removed from its cassette. Strips of negative film are processed by transporting them, either as a single individual strip or as a continuous length comprising two or more strips of shorter lengths, through a series of processing solutions in various tanks in the processing apparatus.

In known processing apparatus, the film strip is pulled through tanks containing the processing solutions either by a leader which is attached to the leading edge of the film strip, or by moving a rack or spiral containing the film strip from tank to tank. Individual film strips may be pre-spliced into a long reel with a leader card at the front end, clipped to a rack, or fed into a spiral.

Where the film strip is attached to a leader, it is unloaded from the cassette and attached to the leader in a manual operation. The leader is then fed into the processing apparatus so that the film can be processed as it is transported through the apparatus.

However, in some processing apparatus, there is a minimum length of film strip which can be processed. As a result, several film strips need to be spliced together prior to processing. This may be time-consuming as each strip will need to be measured to ensure that the minimum processing length is present in the spliced strip prior to processing.

Operations of splicing the film strips together or attaching the leader to the strip need to be carried out in darkroom conditions due to the sensitive nature of the film.

U.S. Pat. No. 4,411,725 describes daylight splicing apparatus in which film is guided through the apparatus under the control of a microprocessor based sensing circuit. Positional information of the film is fed to the sensing circuit via infrared positions sensors.

U.S. Pat. No. 4,947,685 discloses method and apparatus for measuring the repeat length of a moving web. The method includes forming detectable marks along the web at a repeated length interval. The length interval is subsequently detected by detecting one mark moving past a first detector and then detecting the same mark moving past a second detector which is spaced apart a given distance from the first detector, and measuring the time interval between the two readings. The repeat length is then determined using the separation of the detectors, the speed of the web and the time between detection of the mark by the two detectors.

U.S. Pat. No. 4,366,372 describes an arrangement for determining the length of a moving web by detecting a series of equidistant holes spaced along one edge of the moving web. The arrangement comprises an optical device for converting holes into light pulses which are then counted to give a measurement of the length of the web. Simultaneously, a mechanical encoder is used to provide pulses to a counter which counts down from a predetermined value. The difference in value between the mechanical counter and the optical counter provides an indication of deviation from a standard.

U.S. Pat. No. 4,906,854 discloses apparatus and method for the determination of positional information in relation to a film strip. The apparatus includes means for relating image area information with perforations arranged along the length of the film strip. The perforations along one edge of the film strip are counted by two spaced apart detectors which allow the desired information to be accessible even though one detector may not be able to read the perforations due to the presence of splice tape. An array is used to scan the image areas to determine the image area information.

However, in the apparatus described in U.S. Pat. No. 4,906,854, the two detectors for the perforations need to be spaced apart a distance which exceeds the length of any splicing tape which may be used to splice together two or more film strips. This apparatus has the disadvantage that short lengths of film strip cannot be readily measured.

It is therefore an object of the present invention to provide a film checking device which allows different lengths of film strip to be measured whilst still in a loading device for photographic processing apparatus, and for determining whether each strip exceeds the minimum length required which can be processed in the apparatus to which the loading device is attached.

SUMMARY OF THE INVENTION

According to one aspect of the present invention, there is provided a loading device for a photographic processing apparatus comprising:

a film unloading station in which film to be processed is unloaded from its cassette, and a film transfer station in which the film is transferred to the photographic processing apparatus, characterized in that the loading device includes a film checking station for checking the length of the film as it is unloaded from its cassette and prior to its transfer to the film transfer station.

By this arrangement, the length of the film to be processed can be automatically checked as it is removed from its cassette and any lengths which do not exceed a minimum length requirement can be removed from the loading device prior to entering the photographic processing apparatus where it may cause film jams.

BRIEF DESCRIPTION OF THE DRAWINGS

For a better understanding of the present invention, reference will now be made, by way of example only, to the accompanying drawings in which.

DESCRIPTION OF THE PREFERRED EMBODIMENT

Figure 1:
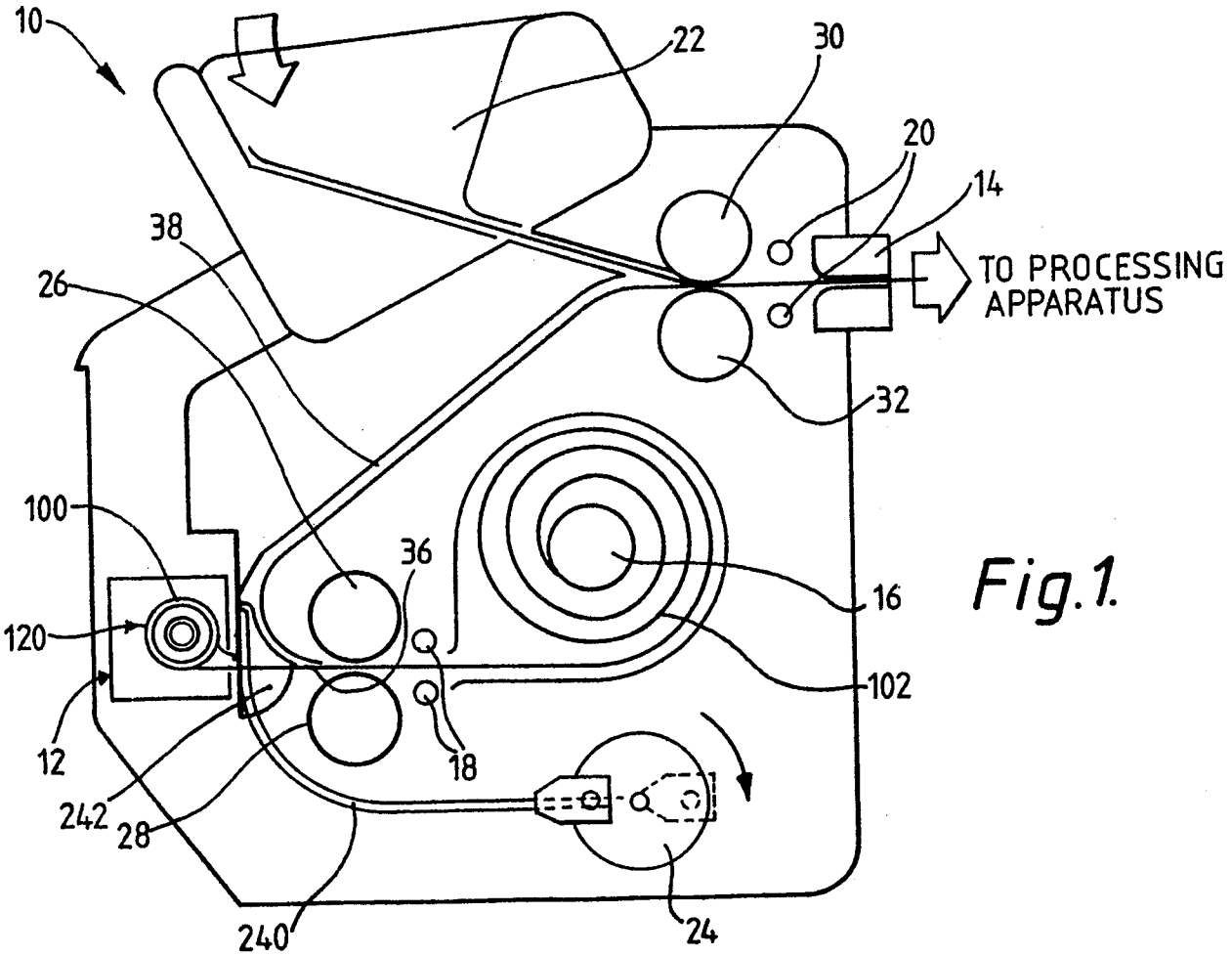
FIG. 1 illustrates a schematic side elevation of a loading device.

A loading device 10 is shown in FIG. 1 and comprises a cassette unloading station 12, a film delivery station 14 connected to processing apparatus (not shown), a storage station 16, a film length checking station 18, a film position checking station 20, a direct film loading station 22, and a cutting station 24. Pairs of transport rollers 26, 28 and 30, 32 are provided to transport the film through the device 10. These rollers are driven by one or more motors (not shown).

At the cassette unloading station 12, a film cassette 100 is positioned in a cassette-shaped aperture 120 with a free end of the film, otherwise called the film leader or the tongue, extending through the cassette wall. The length of the film leader or tongue is determined by a guide (not shown) which is positioned on the outside of the device 10. A slot (not shown) is arranged in the casing of the device 10 so that the film leader can be introduced into the device 10 and positioned between transport roller pair 26, 28, which are initially spaced apart.

Once the cassette 100 is loaded into the cassette unloading station 12 and the film leader is positioned between roller pair 26, 28, the device 10 can be operated and unloading of the film from its cassette can take place.

Roller 26 is a pinch roller which is movable between a first position in which it is not in contact with roller 28, and a second position in which it is in contact with roller 28. The roller 26 is moved between these two positions by a first motor (not shown).

Roller 28 is a drive roller and is driven by a second motor (also not shown). A clutch arrangement (not shown) is associated with roller 28 and the second motor, the clutch slipping when all the film 102 has been unwound from its cassette 100 to prevent the motor stalling. Operation of the cutting station 24 is then initiated.

Once the cassette 100 is correctly positioned as discussed above, i.e. with the film leader positioned between rollers 26, 28, the first motor operates to move roller 26 against roller 28. The second motor then operates to drive roller 28 and the film 102 is pulled out of its cassette 100 and into the storage station 16, along a first film path 36 which extends between the cassette unloading station 12 and the storage station 16, by roller 28 acting against roller 26. The slot in the casing of the device 10, as mentioned above, is located to coincide with at least the portion of the first film path 36 with extends between the cassette unloading station 12 and the transport rollers 26, 28 are arranged along this path 36.

As the film is unwound from its cassette 100, it is transported along path 36 and into storage station 16, its length is checked by the film length checking station 18. This station comprises a pair of spaced apart sensors (not shown in detail) to count or detect the presence of perforations or sprocket holes in the film 102.

Once all the film 102 has been unwound from the cassette 100, the second motor is inactivated and drive to the roller 28 is shut down. The cutting station 24 then comes into operation. This station comprises a guillotine blade 240 driven by a third motor and associated gearbox (not shown) to move in an upwardly direction from the base of the device 10. The blade 240 is rotated through an angle of 180° by the third motor, and in so doing, cuts through the film 102 at a position adjacent the film unloading station 12 to release it from the spool (not shown) to which it is attached inside the cassette 100. The guillotine blade 240 carries a guide 242 adjacent its cutting edge as shown.

Once the film has been cut, the cassette 100 can be discarded from the unloading station 12 and recycled as desired.

It is to be noted that film 102 is not all wound into the storage station 16 as roller 28 is inactivated prior to operation of the cutting station 24. This means that there is a portion of the film 102 adjacent the newly severed leading edge which is trapped between roller pair 26, 28.

Provided the length of the film exceeds a minimum predetermined value as measured by the film length checking station 18, the second motor is activated once more in the opposite direction so that roller 28, in conjunction with pinch roller 26, will then transport the film 102, with its newly severed end leading, along second film path 38 towards the other pair of transport rollers 30, 32.

The second film path 38 includes the first film path 36, but the film 102 is driven along it in the opposite direction. The guide 242 attached to the guillotine blade 240 acts to direct the film 102 from the first film path 36 upwardly into the upper portion of the second film path 38.

Transport roller pair 30, 32 comprises a pinch roller 30 and a drive roller 32 in similar fashion to transport roller pair 26, 28. As the film 102 is driven towards roller pair 30, 32, the pinch roller 30 is spaced away from the drive roller 32 and the newly severed leading edge of the film leader can pass therebetween up to the film position checking station 20. Once the presence of the film 102 has been sensed at the checking station 20, the second motor is inactivated and a fourth motor operates to bring the pinch roller 30 into contact with drive roller 32.

The first motor is then operated to lift roller 26 off roller 28 so that the film 102 can be controlled from the roller pair 30, 32.

When the control system of the processing apparatus asks for the film 102, drive is provided to drive roller 32 by a fifth motor (not shown). The film 102 is then driven to the film delivery station 14 for entry into the processing apparatus.

Once the leading edge of the film 102 has been engaged by the drive system of the processing apparatus, the fourth motor operates to lift pinch roller 30 off drive roller 32 and allows the movement of the film to be controlled by the processing apparatus.

Once all the film has been delivered to the processing apparatus, drive to drive roller 30 is stopped, and the guillotine blade 240 is then returned to its rest position in the device 10 by rotating it through a further 180° under the control of the third motor.

After passing between rollers 30, 32, the film length may be checked again at the film position checking station 20 prior to the film being driven through the film delivery station 14 and into the processing apparatus.

The roller pair 30, 32 and the film position checking station 20 may have an additional function, namely, that of transporting and checking the length of film strips which are introduced manually into the direct loading station 22.

Figure 2:
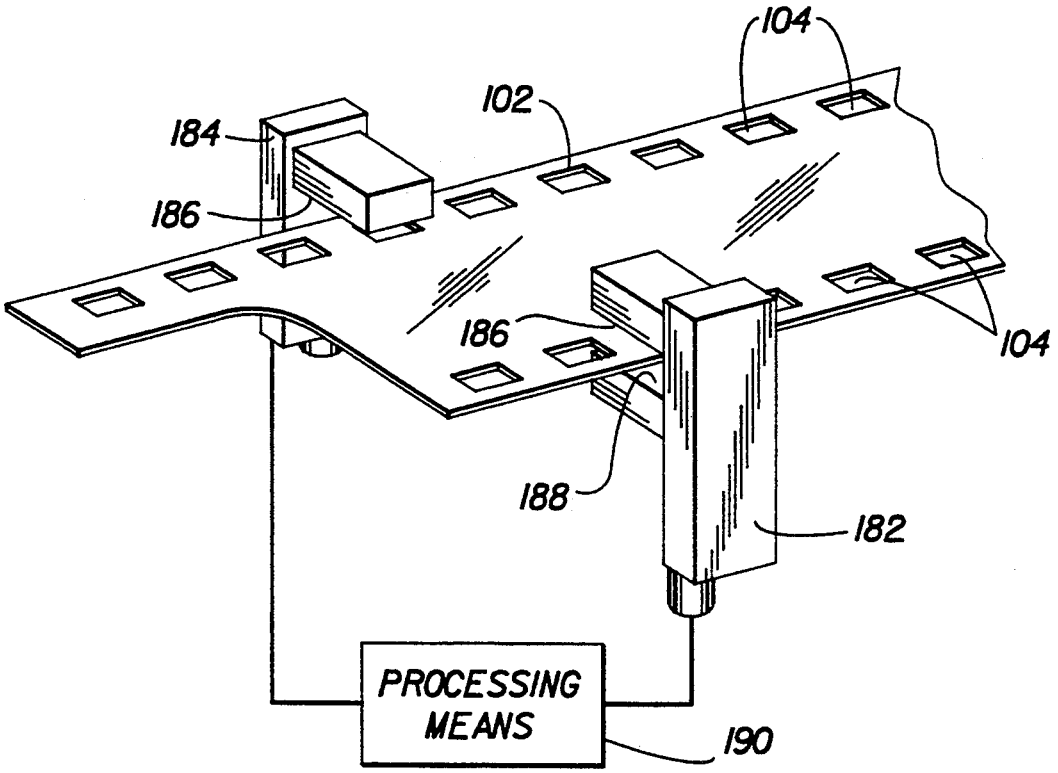
FIG. 2 illustrates a film checking device for use in the FIG. 1 loading device.

In FIG. 2, the film length checking station 18 is shown in more detail. The station 18 comprises a pair of infrared sensor units 182, 184 which are positioned one either side of the film 102 as shown. The sensor units 182, 184 are offset from one another by half the spacing between perforations, and are arranged to detect perforations 104 formed along each longitudinally extending edge of the film 102 as it passes through them. The output from each sensor unit 182, 184 is thus complementary to the output from the other sensor unit, and can be used to determine the direction of film movement.

Each sensor unit 182, 184 comprises an infrared emitter (186) and an infrared detector (188). The detector receives pulses of infrared radiation as each perforation 104 passes between it and the infrared emitter. These pulses are counted by processing apparatus (190) associated with the loading device 10.

As the perforations 104 are regularly spaced along the longitudinal edges of the film 102, the length of the film 102 can be determined to within one perforation spacing.

The output from the sensor units 182, 184 may also be used to monitor the film speed and direction to ensure that the film 102 is being correctly transported through the loading device 10.

Storage station 16 preferably includes an access port (not shown) through which lengths of film which do not exceed the minimum length requirements can be removed. The port may be fitted with a glove-bag attachment to allow the film to be removed without exposing it to light.

It may be desirable to incorporate an alarm which is activated by the film position checking station 20 to indicate to the operator that the film is not of the appropriate length.

It may also be desirable to arrange for a transfer zone between the film delivery station 14 and the processing apparatus so that short lengths of film which have been inadvertently introduced into the loading device 10 via the direct loading station 22 can be removed prior to reaching the processing apparatus.

We claim:

1. A loading device for a photographic processing apparatus comprising:

a film unloading station in which film to be processed is unloaded from its cassette, and a film transfer station in which the film is transferred to the photographic processing apparatus, characterized in that the loading device includes a film checking station for checking the length of the film as it is unloaded from its cassette and prior to its transfer to the film transfer station.

2. A device according to claim 1, wherein the film checking station comprises a pair of offset sensor units which provide output signals in accordance with perforations formed in the film as the film is driven past them.

3. A device according to claim 2, wherein the sensor units each comprise an infrared emitter positioned on one side of the film and an infrared detector positioned on the other side of the film, the detector producing pulses in accordance with the detection of a perforation.

4. A device according to claim 2, wherein processing means are further provided for processing the output signals produced by the sensor units.

5. A device according to claim 1, further including a storage station in which the film is stored after its length has been checked and prior to being moved to the film transfer station.

6. A loading device for a photographic processing apparatus comprising:

a film unloading station in which film to be processed is unloaded from its cassette, and a film transfer station in which the film is transferred to the photographic processing apparatus, characterized in that the loading device includes a film checking station for checking the length of the film as it is unloaded from its cassette and prior to its transfer to the film transfer station and a storage station in which the film is stored after its length has been checked and prior to being moved to the film transfer station.

7. A device according to claim 1, wherein the film checking station comprises a pair of offset sensor units which provide output signals in accordance with perforations formed in the film as the film is driven past them.

8. A device according to claim 2, wherein the sensor units each comprise an infrared emitter positioned on one side of the film and an infrared detector positioned on the other side of the film, the detector producing pulses in accordance with the detection of a perforation.

9. A device according to claim 2, wherein processing means are further provided for processing the output signals produced by the sensor units.

10. A method of unloading a filmstrip from a cassette and preparing it for delivery to a photographic processing apparatus, comprising the steps of:

a) unloading a photographic film strip from its cassette and passing it onto a storage station, b) monitoring the length of the filmstrip as it is being unloaded from its cassette and prior to its transfer to the adjacent photoprocessing apparatus;

c) determining if the filmstrip has a length which exceeds a minimum length required before it can be thread through the photographic processing apparatus; and d) delivering the filmstrip only if it exceeds the predetermined minimum length required for the photograph processing apparatus.

* * * * *